United States Patent [19]

Hall

[11] Patent Number: 4,996,952

[45] Date of Patent: Mar. 5, 1991

[54] AUTOMOTIVE COOLANT PUMPING SYSTEM

[76] Inventor: Jerry W. Hall, 8 Kenec Dr., Middletown, Ohio 45402

[21] Appl. No.: 407,987

[22] Filed: Sep. 15, 1989

[51] Int. Cl.[5] ..... F01P 5/10

[52] U.S. Cl. ..... 123/41.44; 123/198 C

[58] Field of Search ..... 123/41.28, 41.29, 41.44, 123/198 C

[56] References Cited

U.S. PATENT DOCUMENTS

| | | | |
|---|---|---|---|
| 1,484,488 | 2/1924 | Goskins | 123/41.21 |
| 2,094,893 | 10/1937 | Jacoby | 123/41.44 |
| 4,215,658 | 8/1980 | Smith, Jr. et al. | 123/41.44 |
| 4,423,705 | 1/1984 | Morita et al. | 123/41.02 |
| 4,565,163 | 1/1986 | Ishimi et al. | 123/55 VS |
| 4,726,735 | 2/1988 | Field et al. | 416/97 |
| 4,836,147 | 6/1989 | Morris | 123/41.44 |

FOREIGN PATENT DOCUMENTS

| | | | |
|---|---|---|---|
| 842216 | 6/1939 | Fed. Rep. of Germany | 123/41.29 |
| 58-187515 | 11/1983 | Japan . | |

*Primary Examiner*—Noah P. Kamen

*Attorney, Agent, or Firm*—Biebel, French & Nauman

[57] ABSTRACT

A replacement coolant manifold and pump for pumping coolant through an engine, such as a race car, replaces the conventional coolant pump, thereby conserving engine horsepower. The unit comprises a replacement coolant manifold, a pump with an inlet and outlets, and a electrical motor to drive the pump.

2 Claims, 3 Drawing Sheets

AUTOMOTIVE COOLANT PUMPING SYSTEM

BACKGROUND OF THE INVENTION

This invention relates to apparatus for the pumping of coolant through an engine, particularly a race car engine, independent of engine operation, to cool the engine.

In convention automobiles the coolant pump is driven by the engine via a V-belt, therefore depleting some of the horsepower which could be delivered to the drive train. This is a particular concern in race cars where the goal is to deliver as much horsepower to the drive train as possible, in order to win a race. Changing the engine driven coolant pump to an independently driven coolant pump will conserve engine power.

Smith, U.S. Pat. No. 4,215,658 discloses the use of an electrical motor to drive a standard coolant pump instead of a belt drive from the engine. Smith does not replace the conventional coolant pump, nor is the electrical motor attached directly to the coolant pump but merely drives the conventional pump with an electrical motor, through a V-belt, much the same way as the engine drove the pump.

SUMMARY OF THE INVENTION

The present invention replaces the conventional coolant pump with an electrical driven coolant pump. The present invention also has several advantages over conventional coolant pumps in that this invention a coolant manifold replaces the entire standard coolant pump and its connection to coolant passages in the engine is adapted to mount to the existing coolant intakes and is driven by an electrical motor attached to the pump and mounted to such manifold. This provides a rigid, simple, and rapid conversion.

Thus, the object of this invention is to provide a direct electrically driven coolant pump and coolant manifold assembly that replaces the entire conventional coolant pump, and which operates independent of the engine, thus transferring the maximum power to the drive train of an automobile, especially in instances where the automobile is a race car, e.g. drag race car.

Other objects and advantages of the invention will be apparent from the following description, the accompanying drawings and the appended claims.

BRIEF DESCRIPTION OF THE DRAWINGS

In the detailed description below, reference will be made to the following drawings.

DESCRIPTION OF THE PREFERRED EMBODIMENT

Figure 1:
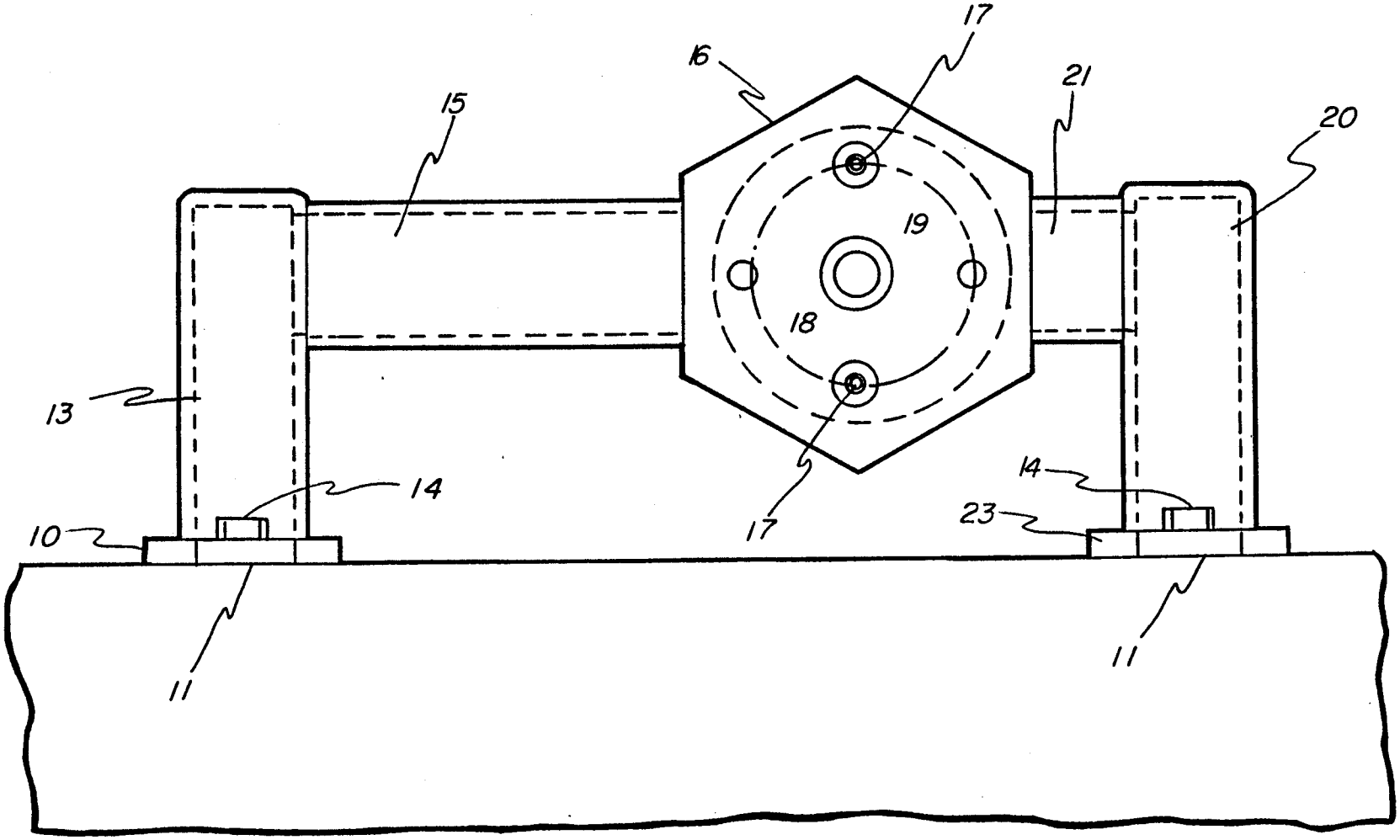
FIG. 1 is a top view of the replacement coolant manifold mounted to an engine.

A top view of the replacement coolant manifold and pump is shown in FIG. 1 mounted to an engine, comprising two formed manifold mounting brackets or flanges 10 and 23, each mounted to the engine coolant intakes 11 by bolts 14, and attached to outlet coolant pipes 13 and 20, which is attached to outlet coolant pipes 15 and 21, thereby attached to the housing of pump 16. The top of said pump 16 has two tapped holes

17, for mounting the electrical motor 25 (shown in FIG. 2), a driving shaft hole 18, and a water seal 19 located in the center of said pump 16. Preferably the aforementioned pipes, mounting brackets, and pump housing are part of an integral piece, e.g. a casting.

Figure 2:
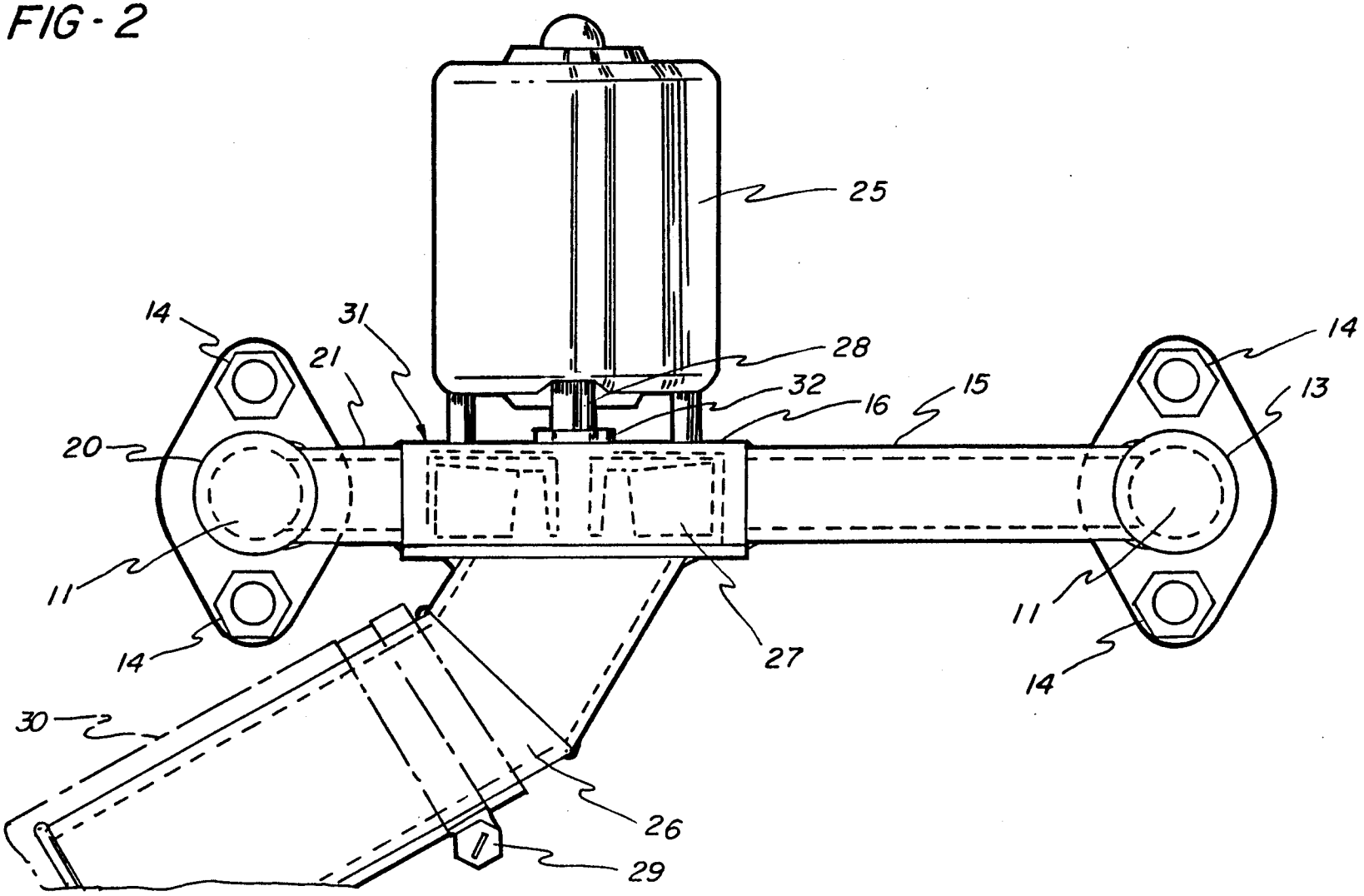
FIG. 2 is a view of the replacement coolant manifold with motor, mounted to an engine, as seen from the front of the engine.
Figure 3:
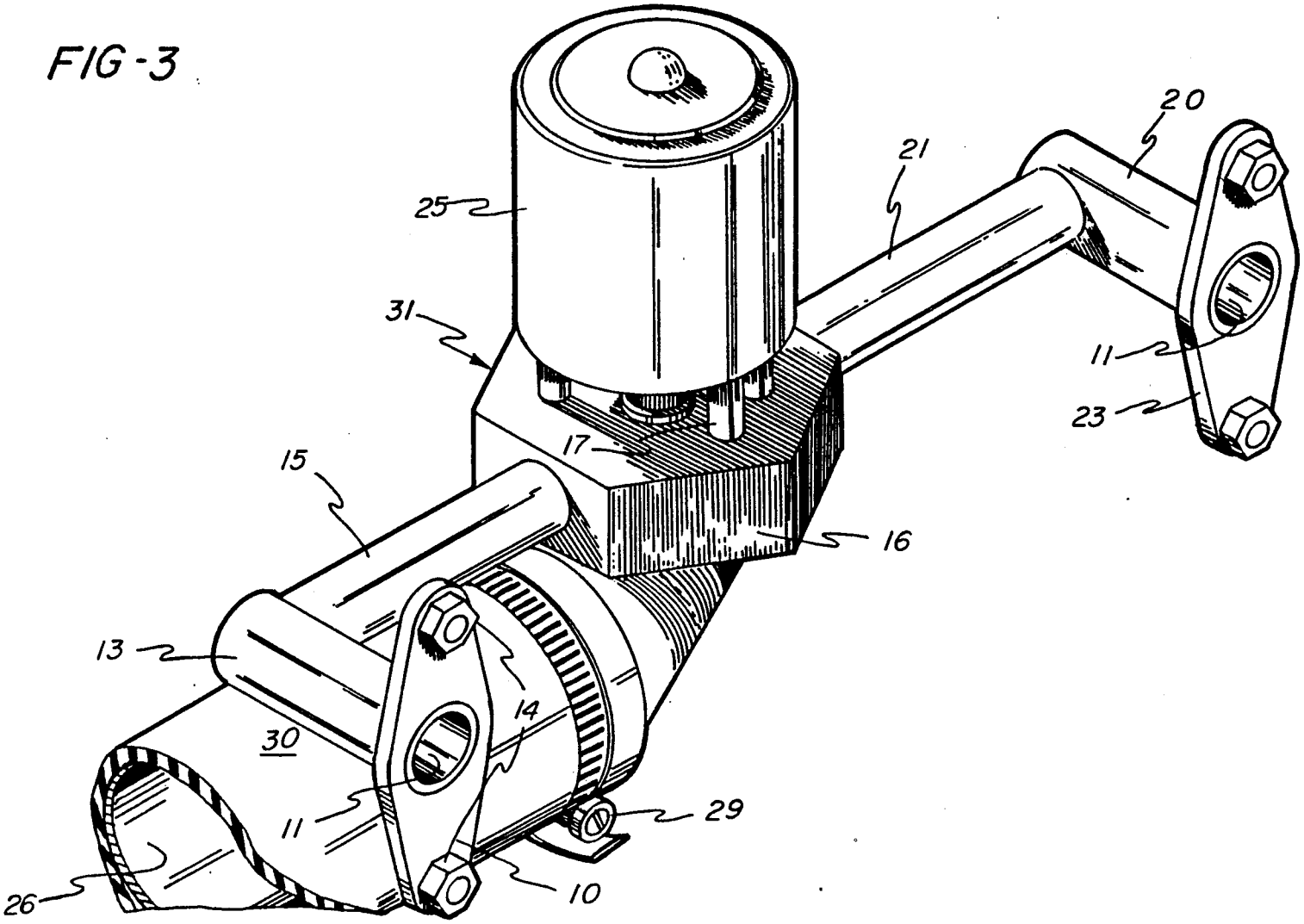
FIG. 3 is a perspective view of the replacement coolant manifold.

FIG. 2 shows the replacement coolant manifold and said pump mounted to the engine coolant intakes 11. Attached to the bottom of pump 16 is an inlet water pipe 26 which has an outside diameter equal to the inside diameter of a radiator hose. A radiator outlet hose 30 is secured to the inlet coolant pipe 26 by hose clamp 29. At the other end of pipe 26, a flange is secured to the bottom of the pump.

The pump 16 shown in FIG. 2 comprises housing 31 which is formed to receive the pump rotor or impeller 27 and cooperate with such impeller to pump coolant from the coolant source, i.e. the radiator hose, to the coolant manifold outlet pipes 15 and 21. Pump 16 is driven by a 12 volt DC electrical motor 25, with drive shaft 28 attached to the pump impeller 27 and water seal 32 around drive shaft 28, in order to prevent the coolant from leaking outside the pump.

In summary, when the engine is started the electrical motor 25, supplied by a 12 volt DC battery, is turned on, thereby rotating the pump impeller 27, thus pumping coolant from the radiator into the coolant pipes 15, 21, 20 and 13, into the engine coolant intakes. This process is continued throughout the running of the engine and the pump can continue to run even after the engine is shut off in order to keep the engine at a desired temperature or to cool the engine down. The entire replacement coolant manifold and pump is mounted by its flanges and is bolted at the existing engine coolant intakes, replacing the standard coolant pump.

While the form of apparatus for herein described constitutes a preferred embodiment of this invention, it is to be understood that the invention is not limited to this precise form of apparatus, and that changes may be made in either without departing from the scope of the invention which is defined in the appended claims.

What is claimed is:

1. A device for replacing the engine driven pumping system of an automotive engine for circulating liquid coolant through an engine with independently driven pumping means (by attaching) attachable to the existing engine coolant intakes, comprising an integral manifold means including an inlet pipe for attaching to the coolant outlet of a radiator, said manifold means also including at least one outlet coolant pipe and bracket means on the ends of said outlet pipe for attachment to and support from the coolant intake of the engine, a pump incorporated in and supported by said manifold means, said pump being arranged to impel liquid coolant flow from said inlet pipe to said outlet pipe, and an electric motor coupled to said pump for driving said pump independent of engine operation.

2. A device, attachable to existing engine coolant intakes, for replacing the engine driven pumping system of an automotive engine for pumping liquid coolant through an engine, comprising a pump including a housing having an inlet and an outlet and an impeller mounted for rotation in said housing, an electric motor secured to said pump housing and connected to drive said impeller, a replacement manifold formed integrally with said pump housing and including an inlet coolant pipe having one end connected to said inlet of said pump housing and having an other end attachable to a source of coolant, said manifold also having two mounting coolant outlet passages, each outlet passage having a formed mounting bracket mountable to the engine coolant intakes and each outlet passage integrally formed at its other end to said outlet of said pump housing.

* * * * *

UNITED STATES PATENT AND TRADEMARK OFFICE

CERTIFICATE OF CORRECTION

PATENT NO. : 4,996,952

DATED : March 5, 1991

INVENTOR(S) : Jerry W. Hall

It is certified that error appears in the above-identified patent and that said Letters Patent is hereby corrected as shown below:

Column 2:
Claim 1, line 46, "(by attaching)" should be deleted.

Signed and Sealed this

Fifteenth Day of September, 1992

*Attest:*

DOUGLAS B. COMER

*Attesting Officer*

*Acting Commissioner of Patents and Trademarks*